US006410479B1

(12) United States Patent
Fukuchi et al.

(10) Patent No.: US 6,410,479 B1
(45) Date of Patent: Jun. 25, 2002

(54) THERMALLY SENSITIVE RECORDING MEDIUM

(75) Inventors: Tadakazu Fukuchi; Kaoru Hamada; Daisuke Imai; Hidenori Ogawa; Yuji Tsuzuki; Reiko Sato; Yoshihide Kimura, all of Shinjuku-ku (JP)

(73) Assignee: Nippon Paper Industries Co Ltd, Tokyo (JP)

( * ) Notice: Subject to any disclaimer, the term of this patent is extended or adjusted under 35 U.S.C. 154(b) by 0 days.

(21) Appl. No.: 09/428,489

(22) Filed: Oct. 28, 1999

(30) Foreign Application Priority Data

| | | |
|---|---|---|
| Oct. 29, 1998 | (JP) | 10-307972 |
| Mar. 10, 1999 | (JP) | 11-063118 |
| Sep. 2, 1999 | (JP) | 11-248554 |

(51) Int. Cl.[7] ..... B41M 5/40
(52) U.S. Cl. ..... 503/226; 427/152; 503/200
(58) Field of Search ..... 503/200, 226; 427/152

(56) References Cited

U.S. PATENT DOCUMENTS

| | | | | |
|---|---|---|---|---|
| 4,977,133 A | | 12/1990 | Ishida et al. | 503/226 |
| 4,985,394 A | | 1/1991 | Mori et al. | 503/226 |
| 5,401,699 A | * | 3/1995 | Ohashi et al. | 503/217 |
| 5,449,237 A | | 9/1995 | Seo | 384/448 |
| 5,677,365 A | | 10/1997 | Kikuta et al. | 523/201 |
| 5,804,528 A | * | 9/1998 | Aoki et al. | 503/204 |
| 5,851,951 A | * | 12/1998 | Yamori et al. | 503/216 |

FOREIGN PATENT DOCUMENTS

| | | |
|---|---|---|
| EP | 0431594 | 6/1991 |
| EP | 0587139 | 3/1994 |
| EP | 0614767 | 9/1994 |

OTHER PUBLICATIONS

Japanese Patent Laid Open Publication 56–146794 (Nov. 14, 1991).

Japanese Patent Laid Open Publication 58–199189 (Nov. 19, 1983).

Japanese Patent Laid Open Publication 01–122483 (May 15, 1989).

Japanese Patent Laid Open Publication 01–178486 (Jul. 14, 1989).

Japanese Patent Laid Open Publication 02–169292 (Jun. 29, 1990).

Japanese Patent Laid Open Publication 02–175281 (Jun. 7, 1990).

* cited by examiner

*Primary Examiner*—Bruce H. Hess
(74) *Attorney, Agent, or Firm*—Sherman & Shalloway

(57) ABSTRACT

A thermally sensitive recording medium which has good printability and surface glossness, by forming a glossing layer on a thermally sensitive recording layer on a substrate, and said glossing layer contains an inorganic pigment and a fixing composition which does not cause sticking at higher temperature than 200° C., and the surface glossiness of the glossing layer based on JIS-P-8142 in which angle of incidence and angle of reflect is 75 degree is bigger than 50%.

12 Claims, No Drawings

THERMALLY SENSITIVE RECORDING MEDIUM

BACKGROUND OF THE INVENTION

The present invention relates to a thermally sensitive recording medium whose preservability, printability and glossiness are improved.

DESCRIPTION OF THE PRIOR ART

Generally, a thermally sensitive recording medium having a thermally sensitive layer mainly composed by colorless or pale colored dye precursor which is an electron donating dye precursor (hereinafter shortened to a dye precursor) and a color developer which develops color by a chemical reaction with the dye precursor when heated, is disclosed in Japanese Patent Publication 45-14035 and is widely and practically used. For a recording means of a thermally sensitive recording medium, a thermal printer in which a thermal head is built in is used. This recording method is superior to the conventional ordinary recording methods from the view points of noiseless recording, no need of development and fixing procedures, maintenance free, relatively cheap and compact and very clear image. Therefore, this procedure is widely used in the fields of facsimile and computer, various kinds of measuring equipment and labels.

However, in a case of a conventional thermal recording medium, since only a thermally sensitive recording layer whose main components are dye precursor, color developer and fixing agent is coated on the surface of substrate, the resistances against light, water, heat, plasicizer and oil are not stable and the color change by aging at preservation is pointed out as a problem. Further, in a case of this type of thermal recording medium, the glossiness of image part and non-image part is not considered.

To solve the problem of the conventional thermally sensitive recording medium, a method of forming a protecting layer over the surface of thermally sensitive recording layer has been suggested. For example, the method to use hydrophobic emulsion of high polymer compound is disclosed in Japanese patent Laid Open Publication 56-146794 or the method to form an intermediate layer of water soluble high polymer compound or hydrophobic emulsion of high polymer compound and then to form a surface layer by oil type coating composed by hydrophobic high polymer compound over above mentioned intermediate layer is disclosed in Japanese Patent Laid Open Publication 58-199189. In these methods, the preservative property of the image is improved, however, the glossiness is very low.

In general, UV varnish is coated over the surface of the thermally sensitive recording medium to provide the lustrous property, however, this method has several problems. That is, since the thermally sensitive recording medium by this method generates stickiness during the printing procedure, it is not suited to use with a thermal head. Further, the fixing of ink on this thermally sensitive recording medium is not good and the printing property of it is not sufficient. In Japanese Patent Laid Open Publication 1-178486, the thermally sensitive recording medium having an intermediate layer composed by water soluble high polymer, pigment and cross-linking agent on the thermally sensitive recording layer, further having a glossing layer composed by lustrous hydrophobic high polymer compound and a slipping agent on the intermediate layer is described. However, since this glossing layer is coated using solvent, the working efficiency for coating is very bad and is not sufficient for practical use.

Further, in Japanese Patent Laid Open Publication 2-169292, the thermally sensitive recording medium on which a protecting layer mainly composed by wax, resin, inorganic pigment smaller than 0.5 $\mu$m average diameter or composed mainly by resin and inorganic pigment smaller than 0.5 $\mu$m average diameter is disclosed. And, in Japanese Patent Laid Open Publication 2-175281, the lustrous thermally sensitive recording medium which has protecting layer composed by silica whose average diameter is smaller than 0.05 $\mu$m and/or calcium carbonate and water soluble binder is disclosed. If any of these protecting layers is formed, and printed by a thermal head, glossiness of the surface is deteriorated and sometimes a problem of sticking is generated. Further, in Japanese Patent Laid Open Publication 1-122483, the thermally sensitive recording medium which forms a protecting layer on the thermally sensitive recording layer mainly composed of water soluble resin formed on a substrate, and whose surface glossiness based on JIS-P-8142 is bigger than 40(GS(75°))% is described. However, when this thermally sensitive recording medium is printed by thermal head, sometimes there is a problem that the glossiness is hurt.

BRIEF SUMMARY OF THE INVENTION

The object of the present invention is to solve above mentioned problems and to provide a thermally sensitive recording medium whose suitability for a thermal head and suitability for printing is improved.

The inventors of this invention, have conducted an intensive study and have found that a thermally sensitive recording medium which has good image preserving ability and glossiness can be obtained by forming a glossing layer mainly composed by an inorganic pigment and a fixing composition having heatproof sticking tendency which does not cause sticking at higher temperature on a thermally sensitive recording layer formed on the substrate, and accomplished the present invention.

That is, a thermally sensitive recording medium of this invention is characterized by forming a glossiness layer containing mainly an inorganic pigment and a fixing composition which does not cause sticking at higher temperature than 200° C. on the thermally sensitive recording medium formed on a substrate, and the surface glossiness based on JIS-P-8142 (an angle of incidence and an angle of reflection is 75°) of the glossiness layer is higher than 50%. If more improved image preservative ability and glossiness are required, it is effective to form an intermediate layer between the thermally sensitive recording layer and a glossiness layer composed mainly by inorganic pigment and fixing composition.

DETAILED DESCRIPTION OF THE INVENTION

In the present invention, as the example of an inorganic pigment used in the glossiness layer or in the intermediate layer, the compound which does not hurt the property as the thermally sensitive recording medium and glossiness can be used. As the concrete example, metal oxide such as silica, colloidal silica, titania, zirconia, alumina, antimony pentaoxide or zinc oxide, metal carbonate such as calcium carbonate or magnesium carbonate, aluminum hydroxide and barium sulfate can be mentioned, however, it is not intended to be limited to these pigments. These compounds can be used singly or in combination. Especially among these compounds, colloidal silica and barium sulfate are very useful to obtain an excellent lustrous surface because the primary particles of these compounds are stable and do not form flocks, further the refractive index of these particles is comparatively low. And, the dispersion of colloidal silica and barium sulfate is very stable and hardly forms a precipitate, further since fine particles of these compounds can be dispersed in comparatively high concentration, the coating amount can be adjusted to higher level and has high work efficiency. Therefore, these compounds are desirably used.

In this invention the property of fixing composition which does not cause sticking at higher temperature than 200° C. is measured by following method.

(1) On paper of 60g/m$^2$ density and 74 $\mu$m thickness, the fixing composition is coated by 20 g/m$^2$, left for 5 minutes in an oven of 110° C. and the coated layer of fixing composition is completely hardened.

(2) The obtained coated paper is cut to 4 cm×8 cm size and doubled up so that the coated surface with fixing composition is contacted. Thus the specimen of 4 cm×4 cm size is prepared.

(3) The specimen is placed on a hot plate heated to 200° C. and a weight of 500 g (whose base diameter is 4 cm) is placed on the specimen for 5 seconds. Then the specimen is cooled down to room temperature, and checked whether the contacted coated surfaces can be separated easily or not.

In this invention, the fixing composition which does not cause sticking at higher temperature than 200° C. is prescribed as follows. Namely, the specimen whose contacted coated surfaces does not cause sticking, that is, the coated surface does not become sticky and can be separated easily, or causes partial sticking, but can be easily removed, are ranked as the fixing composition which does not cause sticking at higher temperature than 200° C.

In the conventional thermally sensitive recording medium which has lustrous property, the generation of following problems is pointed out. Namely, at the printing procedure, the glossiness is spoiled, striped lines and cracks appear and the printed image becomes blurred. The cause of these problems is the destruction of a glossing layer (or a protecting layer) by instantaneous heating at 200–300° C. of a thermal head. Namely, a binder component in the glossing layer becomes sticky by instantaneous heating and adheres to the thermal head, and since a recording paper is fed through the soiled thermal head, the glossing layer is partially removed. On the contrary, the thermally sensitive recording medium of this invention is an improved one whose heat resistance for destruction is improved by use of a fixing composition which does not cause sticking at higher temperature than 200° C. That is, the glossing layer of this invention does not generate sticking property even if exposed to high temperature, and the removing of glossing layer can be effectively prevented.

As the fixing composition used in the glossing layer of this invention, any composition which does not cause sticking at the higher temperature than 200° C. and does not hurt the thermal sensitivity and lustrous property can be used. Concretely, various kinds of polyvinyl alcohol of 200~2500 polymerization degree such as fully saponified polyvinyl alcohol, partially saponified polyvinyl alcohol, denatured polyvinyl alcohol e.g. polyvinyl alcohol denatured by carboxyl, polyvinyl alcohol denatured by amide, polyvinyl alcohol denatured by sulfonic acid or polyvinyl alcohol denatured by butylal (butyl aldehyde); water soluble high polymer of cellusose derivatives, such as, hydroxyethyl cellulose, methyl cellulose, ethyl cellulose, carboxymethyl cellulose and acetyl cellulose and (meth)acrylic ester resin such as (meth)acrylic ester copolymer, acrylic ester and/or methacrylic ester, copolymer of styrene and/or vinyl acetate, copolymer of acrylamide/acrylic ester/methacrylic acid, copolymer of colloidal silica complex acrylic ester and copolymer of colloidal silica complex styrene/acrylic ester can be mentioned. However, it is not intended to be limited to them.

Among above mentioned water soluble high polymer substances, a highly saponified polyvinyl alcohol has an excellent resistance to sticking by heat, its use is preferred. Especially, the water soluble high polymer substance whose degree of saponification is bigger than 90% and degree of polymerization is bigger than 1000 is preferably used. As concrete examples of these, "PVA-117" (degree of saponification:98.5, degree of polymerization:1700) of KURARAY Co., Ltd. can be mentioned.

In this invention, the property of not causing sticking at the temperature higher than 200° C., is most important, and in comparison with the thermally sensitive recording medium containing the fixing composition which causes sticking at the temperature lower than 200° C., the improvement of the resistance to sticking by heat of the glossiness layer is remarkable. Even if the fixing composition does not display good resistance to sticking by heat at the temperature higher than 200° C., when used alone, if it displays good resistance to sticking by heat by use together with an additive, such as, cross-linking agent, it can be used as the fixing composition which does not cause sticking at the higher temperature than 200°. That is, the fixing compound of this invention is a compound which display fixing ability by single use of the compound or as a composition containing additives.

As the acrylic ester type resin, colloidal silica complex acrylic ester copolymer disclosed in Japanese Patent Laid Open Publication 7-26165, or (meth) acrylic ester copolymer containing core/shell structure disclosed in Japanese Patent Laid Open Publication 6-227124 are desirably used because these compounds display good heat resistance which do not generate sticking by single use at higher temperature than 200° C. As concrete examples of commercialized products "ACRYSET SA-532" (product of NIHON SHOKUBAI Co., Ltd.) and "MOVINYL 8020" (product of CLARIANT POLYMER Co., Ltd.) can be mentioned.

Meanwhile, for example, the glass transition temperature (Tg), which is one of the indexes correlating to heat resistance of a fixing agent, of the acrylic ester type copolymer (commercialized name of the product: MOVINYL 35, product of CLARIANT POLYMER Co., Ltd.), a kind of the acrylic ester type resin, is about 25° C., and is known to display comparatively good heat resistance. However, since such copolymer does not satisfy the important point of this invention, (namely not becoming sticky at the temperature higher than 200° C.), the expected effect can not be obtained from this copolymer.

As the cross-linking agent which can be used in the fixing composition of this invention to prevent the problem of sticking at the temperature higher than 200° C., a well-known cross-linking agent can be used as long as it does not deteriorate the thermal recording property and lustrous property. Concretely, dialdehyde type such as glyoxal or polyaldehyde, polyamine type such as polyethylamine, epoxy type, polyamide resin, melamine resin, diglycydil type, dimethylolurea such as glycerindiglycidylether, further, ammonium persulfate, iron chloride and magnesium chloride can be mentioned, however, the invention is not limited to them. Compared with a three-dimensional bridged type glyoxal cross-linking agent, since a two-dimensional bridged type glyoxal does not deteriorate the glossiness, it is useful for the preparation of excellent lustrous surface. The reason why is unclear, however, it is considered that the light scattering is generated on a micro scale when it is three-dimensionally bridged. The amount of cross-linking agent to be added can be adjusted voluntarily so as to be a fixing composition which does not cause sticking at the temperature higher than 200° C., and for instance, 0.05–0.3 parts can be added to 1 part of water soluble high polymer substance.

In this invention, good image preservative property can be obtained in addition to the improvement of glossiness by preparing an intermediate layer mainly composed by inorganic pigment and fixing composition. The ground which image preservative property is improved is illustrated as follows. That is, by the presence of an intermediate layer, barrier function, namely, the protecting ability to prevent the penetration of water, plasticizer, oil or solvent into a thermally sensitive recording layer is improved.

As the fixing composition contained in the intermediate layer, any composition which generates barrier function and does not hurt the thermally sensitive recording property and lustrous property can be used. Concretely, various kinds of polyvinyl alcohol of 200~2500 polymerization degree such as fully saponified polyvinyl alcohol, partially saponified polyvinyl alcohol, denatured polyvinyl alcohol, e.g., denatured polyvinyl alcohol by carboxyl, denatured polyvinyl alcohol by amide, denatured polyvinyl alcohol by sulfonic acid or denatured polyvinyl alcohol by butylal, water soluble high polymer of cellulose derivatives such as hydroxyethyl cellulose, methyl cellulose, ethyl cellulose, carboxymethyl cellulose and acetyl cellulose and acrylic ester type copolymer resin such as copolymer of (meth)acrylic ester, acrylic ester and/or methacrylic ester, styrene and/or vinyl acetate, copolymer of acrylamide/acrylic ester/methacrylic acid, copolymer of colloidal silica complex acrylic ester and copolymer of colloidal silica complex styrene/acrylic ester can be mentioned. However, it is not intended to be limited to them.

Among above mentioned water soluble high polymer, a highly saponified one or one of high polymerization degree, have a tendency to display high barrier function, and especially a water soluble polymer whose saponification degree is higher than 90% and polymerization degree is higher than 1000. In a case of the intermediate layer, among acrylic ester type resins it is slightly different from the case of glossing layer. In particular, the aforementioned acrylic ester copolymer (commercialized name: MOVINYL 735) is desirably used because it has a good balance of heat resistance and barrier function. Further, when acrylicester resin is contained in the intermediate layer, the glossiness is improved and is desirably used. The reason why is believed to be that the micro smoothness is improved.

Even if a water soluble high polymer can not provide a barrier function to an intermediate layer when used alone, it is possible to improve a barrier function and to use it as a fixing composition in the intermediate layer of this invention by adding a cross-linking agent. As the cross-linking agent which may be used in the fixing composition contained in the intermediate layer of this invention, any kind of well known component which does not hurt the thermally sensitive recording property and the lustrous property can be used. As concrete examples of the cross-linking agent, dialdehyde type, such as, glyoxal or polyaldehyde, polyamine type such as polyethyl amine, epoxy resin, polyamide resin, melamine resin and diglycidyl type dimethylol urea such as glycerin diglycidyl ether, further ammonium persulfate magnesium chloride can be mentioned. However, it is not intended to be limited to them. The amount of the cross-linking agent can be voluntary changed along with the desired property, and the desirable amount is from 0.05–0.35 parts to 1 part of the water soluble high polymer.

Referring to the water soluble polymer such as polyvinyl alcohol used in the glossing layer or the intermediate layer of this invention, the coating viscosity (B type viscometer or high shear type viscometer) becomes high at the preparation of coating, therefore, have a strong point that the coating can be easily coated and high coating amount can be obtained. Therefore, the use of water soluble polymer, such as, polyvinyl alcohol, together with acrylic ester type resin as the fixing composition in the glossing layer or the intermediate layer of this invention is a particularly desirable embodiment. Referring to the lustrous property, since an excellent degree of glossiness can be obtained when the coating amount of glossing layer and intermediate layer is big, small amount of polyvinyl alcohol can be added to provide a coating aptitude, even if other fixing composition is mainly used for the glossing layer or the intermediate layer. In this case, the amount of polyvinyl alcohol to be added is 0.01–0.15 parts to 1 part of fixing composition.

Further, it is effective to add a slipping agent in the glossing layer or the intermediate layer of this invention, for the purpose of improving the thermal head compatibility. As a slipping agent, the slipping agents which are generally used in the conventional thermally sensitive recording medium can be used. As the concrete example, metallic salt of high fatty acid such as zinc stearate or calcium stearate and wax such as paraffin wax, polyethylene wax, carnauba wax, micro crystalline wax and acrylic type wax can be mentioned. Especially, when the thermal head compatibility is concerned, zinc stearate or calcium stearate are desirably used. Further, if the slipping agent is contained in the glossing layer or in the intermediate layer, the phenomenon that the degree of glossiness is improved is observed. The reason for this phenomenon is illustrated as follows. That is, the lustrous property is improved along with the improvement of the surface smoothness.

The inorganic pigment or slipping agent contained in the glossing layer or the intermediate layer, the fixing composition contained in the glossing layer which does not cause sticking at the temperature higher than 200° C. and fixing composition contained in the intermediate layer provide an excellent lustrousness when their average particle size is finer than 0.3 $\mu$m. Since, this phenomenon is believed to be due to the control of scattering of visible ray by these components, when better glossiness is required, the content of particles bigger than 0.3 $\mu$m must be little. Concretely, by limiting the amount of particles bigger than 0.3 $\mu$m size to less than 0.03 parts to 1 part of particles smaller than 0.3 $\mu$m. Thus, the lustrous degree higher than 70% can be obtained. Especially, in a case of the material which has higher refraction index, the average particle size greatly affects degree of glossiness. So, it is effective to use finer average size to obtain good degree of glossiness. It is more desirable to use fine particles whose average particle size is finer than 0.2 $\mu$m to obtain higher degree of glossiness. The particles of these material has an adequate distribution curve, and when the average particle size is finer than 0.2 $\mu$m, the size of almost all particles is smaller than the wave length of visible rays.

The kinds and the amount of an inorganic pigment, a fixing composition which does not cause sticking, a slipping agent or other additives contained in the glossing layer of this invention are decided according to the required degree of glossiness are not particularly limited, however, in general, the adequate amount of fixing composition which does not cause sticking at the temperature higher than 200° C. is 0.6–3.5 parts desirably 0.75–3.5 parts to 1 part of inorganic pigment, and that of slipping agent is 0.06–1 parts to 1 part of inorganic pigment. Especially, in the case of using paper as a substrate, it is desirable to use 1.0–3.5 parts of fixing composition which does not cause sticking at the temperature higher than 200° C. to 1 part of inorganic pigment. On the basis of the total amount of solid contained in the glossing layer, the desirable amount of inorganic pigment and fixing composition which does not cause sticking at the temperature higher than 200° C. are respectively 30–60%. Further, by increasing the coating amount to the glossing layer, higher degree of glossiness can be obtained, and ordinary adequate amount is 1–10 g/m$^2$.

When an intermediate layer is prepared between the thermally sensitive recording layer and the glossing layer of this invention, the kinds and the amount of inorganic pigment, fixing composition, slipping agent or other additives contained in the intermediate layer are not limited. However, the desirable amount of inorganic pigment and fixing composition is respectively 30–60% to the total amount of solid contained in the intermediate layer. Further, the amount of coating of the intermediate layer is decided according to the desired image preservative property and degree of glossiness, however, the ordinary adequate amount is 1–4g/m, and if the excellent image preservative property is required the effective coating amount is 2–4g/m$^2$.

The thermally sensitive recording layer of this invention can be prepared by dispersing colorless or pale color dye precursor and organic color developer with binder, adding sensitizer, filler, UV absorbing agent, water proof agent or defoamer as needed and coating and drying the obtained coating over the surface of a substrate.

As a dye precursor used in this invention, all kinds of dye precursors which are well known in the field of pressure sensitive or thermally sensitive recording paper can be used and triphenylmethane type compound, fluorane type compound, fluorene type compound and divinyl type compound are desirably used, however, it is not intended to be limited to them. The concrete examples are shown below. These dye precursors can be used alone or can be used as mixtures of two or more of them.

<Triphenylmethane type leuco dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran type leuco dyes>

3-diethylamino-6-methylfluoran
3-diethylamino-6-methyl-7-anilinofluoran
3-diethylamino-6-methyl-7-(o,p-dimethylanilino)fluoran
3-diethylamino-6-methyl-7-chlorofluoran
3-diethylamino-6-methyl-7-(m-trifluoromethylanilino)fluoran
3-diethylamino-6-methyl-7-(m-methylanilino)fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-n-octylanilinofluoran
3-diethylamino-6-methyl-7-n-octylaminonofluoran
3-diethylamino-6-methyl-7-benzylanilinofluoran
3-diethylamino-6-methyl-7-dibenzylanilinofluoran
3-diethylamino-6-chloro-7-methylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethylamino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylamino-6-methyl-7-(o,p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino)fluoran
3-dibutylamino-6-methyl-chlorofluoran
3-dibutylamino-6-ethoxyethyl-7-anilinofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroanilino)fluoran
3-di-n-pentylamino-7-(m-trifluoromethylanilino)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-n-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl)aminoanilinofluoran 2-methoxy-6-p-(p-dimethylaminophenyl)aminoanilinofluoran 2-chloro-3-methyl-6-p-(p-phenylaminophenyl)aminoanilinofluoran 2-chloro-6-p-(p-dimethylaminophenyl)aminoanilinofluoran 2-nitro-6-p-(p-diethylaminophenyl)aminoanilinofluoran 2-amino-6-p-(p-diethylaminophenyl)aminoanilinofluoran 2-diethylamino-6-p-(p-diethylaminophenyl)aminoanilinofluoran 2-phenyl-6-metyl-p-(p-phenylaminophenyl)aminoanilinofluoran 2-benzoyl-6-p-(p-phenylaminophenyl)aminoanilinofluoran 2-hydroxy-6-p-(p-phenylaminophenyl)aminoanilinofluoran 3-methyl-6-p-(p-dimethylaminophenyl)aminoanilinofluoran 3-diethylamino-6-p-(p-diethylaminophenyl)aminoanilinofluoran 3-diethylamino-6-p-(p-dibutylaminophenyl)aminoanilinofluoran 2,4-dimethyl-6-[(4-dimethylamino)anilino]-fluoran <Fluorene type leuco dyes>

3,6,6'-tris(dimethylamino)spiro[fluorene-9,3'-phthalide]

3,6,6'-tris(diethylamino)spiro[fluorene-9,3'-phthalide]

<Divinyl type leuco dyes>

3,3-bis-[2-(p-dimethylaminophenyl)-2-(p-methoxyphenyl)ethenyl]-4,5,6,7-tetrabromophthalide 3,3-bis-[2-(p-dimethylaminophenyl)-2-(p-methoxyphenyl)ethenyl]-4,5,6,7-tetrachlorophthalide 3,3-bis-[1,1-bis(4-pyrrolidinophenyl)ethylen-2-yl]-4,5,6,7-tetrabromophthalide 3,3-bis-[1-(4-methoxyphenyl)-1-(4-pyrrolidinophenyl)ethylen-2-yl]-4,5,6,7-tetrachlorophthalide <Others>

3-(4-diethylamino-2-ethoxyphenyl)-3-(1-ethyl-2-methylindol-3-yl)-4-azaphthalide 3-(4-diethylamino-2-ethoxyphenyl)-3-(1-octyl-2-methylindol-3-yl)-4-azaphthalide 3-(4-cyclohexylethylamino-2-methoxyphenyl)-3-(1-ethyl-2-methylindol-3-yl)-4-azaphthalide 3,3-bis(1-ethyl-2-methylindol-3-yl)phthalide 3,6-bis(diethylamino)fluoran-γ-(3'-nitro)anilinolactam 3,6-bis(diethylamino)fluoran-γ-(4'-nitro)anilinolactam 1,1-bis-[2',2',2",2"-tetrakis-(p-dimethylaminophenyl)-ethenyl]-2,2-dinitrilethane 1,1-bis-[2',2',2",2"-tetrakis-(p-dimethylaminophenyl)-ethenyl]-2, -β-naphthoylethane 1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonic acid dimethyl ester.

As examples of organic color developers which may be used in this invention, bisphenol A, 4-hydroxybenzoic acid esters, 4-hydroxyphthalic acid diesters, phthalic acid monoesters, bis-(hydroxyphenyl)sulfides, 4-hydroxyphenylarylsulfones, 4-hydroxyphenylarylsulfonates, 1,3-di[2-(hydroxyphenyl)-2-propyl]-benzenes, 4-hydroxybenzoyloxybenzoic acid esters, derivatives of aminobenzenesulfonamide described in Japanese Patent Laid Open Publication 08-59603, diphenylsulfone cross-linkable type compound described in International Patent Laid Open publication WO97/16420 and bisphenolsulfones described in Japanese Patent Laid Open Publication 03-207688 and Japanese Patent Laid Open Publication 05-24366 can be mentioned. Typical examples of prior color developers are shown below, but it is not intended to be limited to these compounds. These compounds can be used alone or can be used together with each other. Among these compounds, 2,4'-sulfonildiphenyl (another name is 2,4'-bisphenol S) and derivatives of aminobenzenesulfonamide have remarkably good heat resistance, and are suited for the use in which heat resistance is required.

<bisphenol A type>

4,4'-isopropylidenediphenol (another name is bisphenol A), 4,4'-cyclohexylidenediphenol, p,p'-(1-methyl-n-hexylidene)diphenol, 1,7-di(hydroxyphenylthio)-3,5-dioxaheptane.

<4-hydroxybenzoic acid ester type>

4-hydroxybenzyl benzoate, 4-hydroxyethyl benzoate, 4-hydroxypropyl benzoate, 4-hydroxyisopropyl benzoate, 4-hydroxybutyl benzoate, 4-hydroxyisobutyl benzoate, 4-hydroxymethylbenzyl benzoate.

<4-hydroxyphthalic acid diester type>

4-hydroxydimethylphthalate, 4-hydroxydiisopropylphthalate, 4-hydroxydibenzylphthalate, 4-hydroxydihexylphthalate.

<phthalic acid monoester type> monobenzyl phthalate, monocyclohexyl phthalate, monophenyl phthalate, monomethylphenyl phthalate, monoethylphenyl phthalate, monopropylbenzyl phthalate, monohalogenbenzyl phthalate, monoethoxybenzyl phthalate.

<bis-(hydroxyphenyl)sulfide type> bis-(4-hydroxy-3-tert-butyl-6-methylphenyl)sulfide, bis-(4-hydroxy-2,5-dimethylphenyl)sulfide, bis-(4-hydroxy-2-methyl-5-ethylphenyl)sulfide, bis-(4-hydroxy-2-methyl-5-isopropylphenyl)sulfide, bis-(4-hydroxy-2,3-dimethylphenyl)sulfide, bis-(4-hydroxy-2,5-dimethylphenyl)sulfide, bis-(4-hydroxy-2,5-diisopropylphenyl)sulfide, bis-(4-hydroxy-2,3,6-trimethylpheny l)sulfide, bis-(2,4,5-trihydroxyphenyl)sulfide, bis-(4-hydroxy-2-cyclohexyl-5-methylphenyl)sulfide, bis-(2,3,4-trihydroxyphenyl)sulfide, bis-(4,5-dihydroxy-2-tert-butylphenyl)sulfide, bis-(4-hydroxy-2,5-diphenylphenyl)sulfide, bis-(4-hydroxy-2-tert-octyl-5-methylphenyl)sulfide.

<4-hydroxyphenylarylsulfone type>

4-hydroxy-4'-isopropoxydiphenylsulfone, 4-hydroxy-4'-n-propoxydiphenylsulfone, 4-hydroxy-4'-n-butyloxydiphenylsulfone.

<4-hydroxyphenylarylsulfonate type>

4-hydroxyphenylbenzenesulfonate, 4-hydroxyphenyl-p-tolylsulfonate, 4-hydroxyphenylmethylenesulfonate, 4-hydroxyphenyl-p-chlorobenzenesulfonate, 4-hydroxyphenyl-p-tert-butylbenzenesulfonate, 4-hydroxyphenyl-p-isopropoxybenzenesulfonate, 4-hydroxyphenyl-1'-naphthalenesulfonate, 4-hydroxyphenyl-2'-naphthalenesulfonate.

<1,3-di[2-(hydroxyphenyl)-2-propyl]benzene type>

1,3-di[2-(4-hydroxyphenyl)-2-propyl]benzene, 1,3-di[2-(4-hydroxy-3-alkylphenyl)-2-propyl]benzene, 1,3-di[2-(2,4-dihydroxyphenyl)-2-propyl]benzene, 1,3-di[2-(2-hydroxy-5-methylphenyl)-2-propyl]benzene.

<resorcinol type>

1,3-dihydroxy-6(α,α-dimethylbenzyl)-benzene.

<4-hydroxybenzoyloxybenzoic acid ester type>

4-hydroxybenzoyloxybenzyl benzoate, 4-hydroxybenzoyloxymethyl benzoate, 4-hydroxybenzoyloxyethyl benzoate, 4-hydroxybenzoyloxypropyl benzoate, 4-hydroxybenzoyloxybutyl benzoate, 4-hydroxybenzoyloxyisopropyl benzoate, 4-hydroxybenzoyloxy-tert-butyl benzoate, 4-hydroxybenzoyloxyhexyl benzoate, 4-hydroxybenzoyloxyoctyl benzoate, 4-hydroxybenzoyloxynonyl benzoate, 4-hydroxybenzoyloxycyclohexyl benzoate, 4-hydroxybenzoyloxyβ-phenethyl benzoate, 4-hydroxybenzoyloxyphenyl benzoate, 4-hydroxybenzoyloxyα-naphthyl benzoate, 4-hydroxybenzoyloxyβ-naphthyl benzoate, 4-hydroxybenzoyloxy-sec-butyl benzoate <bisphenolsulfone type (I)> bis-(3-1-butyl-4-hydroxy-6-methylphenyl)sulfone, bis-(3-ethyl-4-hydroxyphenyl)sulfone, bis-(3-propyl-4-hydroxyphenyl)sulfone, bis-(3-methyl-4-hydroxyphenyl)sulfone, bis-(2-isopropyl-4-hydroxyphenyl)sulfone, bis-(2-ethyl-4-hydroxyphenyl)sulfone, bis-(3-chloro-4-hydroxyphenyl)sulfone, bis-(2,3-dimethyl-4-hydroxyphenyl)sulfone, bis-(2,5-dimethyl-4-hydroxyphenyl)sulfone, bis-(3-methoxy-4-hydroxyphenyl)sulfone, 4-hydroxyphenyl-2'-ethyl-4'-hydroxyphenylsulfone, 4-hydroxyphenyl-2'-isopropyl-4'-hydroxyphenylsulfone, 4-hydroxyphenyl-3'-isopropyl-4'-hydroxyphenylsulfone, 4-hydroxyphenyl-3'-sec-butyl-4'-hydroxyphenylsulfone, 3-chloro-4-hydroxyphenyl-3'-isopropyl-4'-hydroxyphenylsulfone, 2-hydroxy-5-t-butylphenyl-4'-hydroxyphenylsulfone, 2-hydroxy-5-t-aminophenyl-4'-hydroxyphenylsulfone, 2-hydroxy-5-t-isopropylphenyl-4'-hydroxyphenylsulfone, 2-hydroxy-5-t-octylphenyl-4'-hydroxyphenylsulfone, 2-hydroxy-5-t-butylphenyl-3'-chloro-4'-hydroxyphenylsulfone, 2-hydroxy-5-t-butylphenyl-3'-methyl-4'-hydroxyphenylsulfone, 2-hydroxy-5-t-butylphenyl-3'-isopropyl-4'-hydroxyphenylsulfone, 2-hydroxy-5-t-butylphenyl-2'-methyl-4'-hydroxyphenylsulfone.

<bisphenolsulfone type (II)>

4,4'-sulfonyldiphenol, 2,4'-sulfonyidiphenol, 3,3'-dichloro-4,4'-sulfonyidiphenol, 3,3'-dibromo-4,4'-sulfonyidiphenol, 3,3',5,5'-tetrabromo-4,4'-sulfonyidiphenol, 3,3'-diamino-4,4'-sulfonyIdiphenol.

<others> p-tert-butylphenol, 2,4-dihydroxybenzophenone, novolac type phenolic resin, 4-hydroxyacetophenone, p-phenylphenol, benzyl-4-hydroxyphenylacetate, p-benzylphenol.

4,4'-bis(p-tolylsulfonylaminocarbonilamino)diphenylmethane, 4,4'-bis(phenylaminotiocarbonylamino)diphenylsufido.

Further, metallic chelate type color developing components composed by higher fatty acid metal double salt and polyhydric hydroxy.aromatic compound disclosed in Japanese Patent Laid Open Publication 10-258577 or others can be used as the image forming material. And, these chelate type color developing components can be used alone or can be used together with afore mentioned leuco dye and organic color developer.

In this invention, a conventional well known sensitizer can be used with the limitation that the desired effect of this invention is not prevented. As examples of the sensitizer, stearic acid amide, palmitic acid amide, methoxycarbonyl-N-benzamidestearate, N-benzoyl stearic acid amide, N-eicosenoic acid amide, ethylene-bis-stearic acid amide, behenic acid amide, methylene-bis-stearic acid amide, methylolamide, N-methylolsteric acid amide, dibenzyl terephthalate, dimethyl terephthalate, dioctyl terephthalate, p-benzyloxybenzylbenzoate, 1-hydroxy-2-phenylnaphthoate, dibenzyloxalate di-p-methylbenzyloxalate, di-p-chlorobenzyloxalate, 2-naphthylbenzylether, m-terphenyl, p-benzylbiphenyl, 4-biphenyl-p-tolylether di(p-methoxyphenoxyethyl)ether 1,2-di(3-methylphenoxy)ethane 1,2-di(4-methylphenoxy)ethane 1,2-di(4-methoxyphenoxy)ethane 1,2-di(4-chlorophenoxy)ethane 1,2-diphenoxyethane 1-(4-methoxyphenoxy)-2-(2-methylphenoxy)ethane p-methyltiophenylbenzylether 1,4-di(phenyltio)buthane p-acetotoluidide p-acetophenetidide, N-acetoacetyl-p-toluidine, di-(β-biphenylethoxy)benzene, p-di(vinyloxyethoxy)benzene, 1-isopropylphenyl-2-phenylethane 1,2-bis(phenoxymethyl)benzene p-toluenesulfonamide, o-toluenesulfonamide, di-p-tolylcarbonate and phenyl-α-naphtylcarbonate can be mentioned, however it is not intended to be limited to these compounds. These sensitizers can be used alone or by mixing more than two kinds of them.

As the binder used in the present invention, various kinds of polyvinyl alcohol of 200~2500 polymerization degree such as fully saponified polyvinyl alcohol, partially saponified polyvinyl alcohol, denatured polyvinyl alcohol (e.g. denatured polyvinyl alcohol by carboxyl, denatured polyvinyl alcohol by amide, denatured polyvinyl alcohol by sulfonic acid or denatured polyvinyl alcohol by butylal), derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinyl acetal, polyacrylicamide, polyacrylic acid ester, polyvinylbutyral, polystyrene or copolymer of them,polyamide resin, silicone resin, petroleum resin, terpene resin, ketone resin and cumarone resin can be mentioned. These macro molecule compounds can be applied by being dissolved into solvents such as water, alcohol, ketone, ester or hydrocarbon or by being dispersed in water or other medium under an emulsion state or a paste state and these forms of application can be used in combination according to the quality requirement.

As a filler which can be used in this invention, an inorganic or an organic filler such as silica, calcium carbonate, kaoline, calcined kaoline, diatomaceous earth, talc, titanium oxide, zinc oxide, aluminum hydroxide, polystyrene resin, urea-formaldehyde resin, copolymer of styrene-methacrylic acid, copolymer of styrene-butadiene and hollow plastic pigment can be mentioned.

Further, a parting agent such as metallic salt of fatty acid, a slipping agent such as wax, benzophenon- or triazole-based ultraviolet absorbers, water proof agent such as glyoxal, dispersing agent, defoamers, anti-oxidation agent and fluorescent dye can be used as an additive.

As a substrate, paper, synthetic paper, plastic film, plastic foam film, non-woven fabric, recycled paper metallic foil and a complex of these materials can be used.

The amount of color developer and dye precursor, the kind and amount of other additives to be used in the thermally sensitive recording medium of this invention are decided according to the required quality and recording feature, and are not particularly restricted. However, in general, it is preferable to use 0.1–2 parts of dye precursor, 0.5~4 parts of filler and 0.05–2 parts of stabilizer and sensitizer to 1 part of color developer and 5~25% of binder to the total amount of solid.

The color developer, dye and other additives which are added at need are ground to fine particles smaller than several microns diameter by means of a pulverizer such as a ball mill, an attriter or a sand grinder, or by means of an adequate emulsifying apparatus, then binder and other additives are added at need, thus the coating is prepared. As a method to coat the coating, a hand coating, a size press coating method, a roll coating method, an air knife coating method, a blend coating method, a flow coating method, a comma direct method, a gravure direct method, a gravure reverse method and a reverse roll coating method can be mentioned. Further, the method to dry up after sputtering, spraying or dipping can also be used.

In the thermally sensitive recording medium of this invention, an undercoating layer composed mainly by filler and binder can be formed between thermally sensitive recording layer and substrate for the purpose to improve the quality of image. As the binder, the filler and other additives contained in the undercoating layer, the materials which are indicated as the compound composing the thermally sensitive recording layer can be used according to the required quality. Among these compounds, calcined kaolin, fine hollow spherical particle with shell disclosed in Japanese Patent Publication 3-54074 or cup shape hollow polymer particle disclosed in Japanese Patent Laid Open Publication 10-258577 can be desirably used, because these fillers used to the undercoating layer of the conventional thermally sensitive recording medium has a good function as a heat insulating material. Further, the resistance to water or to chemicals of the recorded image or ground part against the water or chemicals which may bleed out from the back surface of substrate can be improved by containing well known cross-linking agent such as glyoxal.

In the thermally sensitive recording medium of this invention, a back coating layer can be formed under the back surface of the substrate to prevent the bleeding out of water or chemicals from the back surface of the substrate. In this case, it is desirable to use above mentioned binder and cross-linking agent such as glyoxal.

The thermally sensitive recording medium of this invention can be applied to various fields of use. Especially, because of the above mentioned excellent glossiness and image preservative property, it is applied to a thermally sensitive label sheet or a thermally sensitive recording type magnetic ticket paper. In a case of thermally sensitive label, a thermally sensitive recording layer, a glossing layer and an intermediate layer at need are formed on one side of the substrate, and a release paper (liner) is provided on another side of the substrate through an adhesive layer or a sticking agent layer. And in a magnetic ticket paper, a magnetic recording layer mainly composed by strong magnetic substance and fixing agent is formed instead of release paper.

The thermally sensitive recording medium of this invention can obtain an excellent luster without a calendar treatment. If higher degree of glossiness (angle of incidence and angle of reflect is 75°) is required, it is effective to make the surface smoothness higher than 3000 second by Beck Smoothness by a calendar treatment. Thus, by improving surface smoothness of the thermally sensitive recording medium, since the scattering of rays at the surface is controlled, it is effective to obtain higher degree of glossiness. Especially, if degree of glossiness higher than 80% is required, it is desirable to make the smoothness higher than 5000 second.

EXAMPLES

The present invention will be illustrated more concretely by Examples, however, it is not intended to be limited by them. In the Examples and Comparative Examples, "parts" and "%" indicates weight parts and wt %, respectively.

Example 1

<preparation of thermally sensitive recording medium>

Dispersion of color developer (A solution), dispersion of colorless dye precursor (B solution) and dispersion of sensitizer (C solution) of following blending ratio are separately ground in wet condition to average particles diameter of 1 μm by a sand grinder.

| | |
|---|---|
| A solution (dispersion of color developer) | |
| 2,4'-sulfonyldiphenyl [2,4'-bisphenolS] | 6.0 parts |
| 10% aqueous solution of polyvinyl alcohol | 8.8 parts |
| water | 11.2 parts |
| B solution (dispersion of dye precursor) | |
| 3-dibutylamino-6-methyl-7-anilinofluoran [ODB-2] | 2.0 parts |
| 10% aqueous solution of polyvinyl alcohol | 4.6 parts |
| water | 2.6 parts |
| C solution (dispersion of sensitizer) | |
| 1,2-bis(phenoxymethyl)benzene | 3.0 parts |
| 10% aqueous solution of polyvinyl alcohol | 9.4 parts |
| water | 5.6 parts |

The dispersions are mixed by following ratio and the coating is prepared.

| | |
|---|---|
| A solution (dispersion of color developer) | 36.0 parts |
| B solution (dispersion of colorless dye precursor [OBD-2]) | 9.2 parts |
| C solution (dispersion of sensitizer) | 18.0 parts |
| kaolin clay (50% dispersion) | 12.0 parts |

<preparation of coating for glossing layer>

At the preparation of the coating for glossing layer of Example 1, colloidal silica (average particle size: 0.07–0.1 μm, 40% dispersion, commercialized name: SNOWTEX ZL, product of Nissan Chemical Industries Co., Ltd.) as an inorganic pigment, copolymer of colloidal silica complex acrylic ester (average particle size: 0.04 μm, 43% dispersion, commercialized name: MOVINYL 8020, product of Clariant Polymer Co., Ltd., hereinafter shortened to Resin A) as a fixing agent which does not cause sticking at the temperature higher than 200° C. and zinc stearate (average particle size: 0.17 μm, 20% dispersion, commercialized name : HYDRIN F-115, product of Chukyo Yushi Co., Ltd., hereinafter shortened to Slipping agent A) as a slipping agent are used. These compounds are mixed by the mixing ratio shown below, and stirred to form a coating solution (D solution). D solution (dispersion of coating for glossing layer)

| | |
|---|---|
| colloidal silica (40%) | 5.0 parts |
| resin A (43%) | 8.14 parts |
| slipping agent A (20%) | 1.5 parts |

<preparation of a thermally sensitive recording layer>

The prepared coating for thermally sensitive recording layer is coated over the one side surface of 50g/m$^2$ substrate paper at a coating amount of 6.0g/m$^2$, dried up and the thermally sensitive recording layer is prepared. Then the coating for glossing layer is coated over the surface of thermally sensitive recording layer at a coating amount of 3.0 g/m$^2$. After being dried up, it is treated by a super calendar and the thermally sensitive medium of 5000 sec. smoothness is obtained.

Example 2, 3

In Examples 2 and 3, the thermally sensitive recording medium is prepared by same procedure used in Example 1. At the formation of glossing layer, barium sulfate (average particle size: 0.03 μm, 20% dispersion, commercialized name: Barium Sulfate BF-20P, product of Sakai Chemical Industries Co., Ltd., Example 2), titanium oxide (average particle size: 0.015 μm, 20% dispersion, commercialized name: Titanium Oxide MT-100S, product of Teika Co., Ltd., Example 3) are used. The mixing ratios at the preparation of D solution are mentioned below.

Example 2

| | |
|---|---|
| barium sulfate (20%) | 10 parts |

Example 3

| | |
|---|---|
| titanium oxide (20%) | 10 parts |

Example 4

In Example 4, the thermally sensitive recording medium is prepared by same procedure to Example 1. At the formation of glossing layer, copolymer of (metha) acrylic ester (average particle size: 0.37 μm, 25% dispersion, commercialized name: ACRYSET SA-532, product of NIHON SHOKUBAI Co., Ltd., hereinafter shortened to Resin B) is used as a fixing agent which does not cause sticking at the temperature higher than 200° C. The mixing ratios at the preparation of D solution is mentioned below.

| | |
|---|---|
| Resin B (25%) | 14 parts |

Examples 5–8

In Examples 5–8, the thermally sensitive recording medium is prepared by same procedure to Example 1. At the formation of glossing layer, copolymer of (meth)acrylic ester (average particle size: 0.25 μm, 20% dispersion, commercialized name: ACRYSET SA-558, product of NIHON SHOKUBAI Co., Ltd., hereinafter shortened to Resin C, Example 5), polyvinylalcohol (degree of saponification: 98.5%, degree of polymerization: 1700, 10% aqueous solution, commercialized name: PVA-117, product of Kuraray Co., Ltd., hereinafter shortened to Resin D, Example 6), polyvinylalcohol (degree of saponification: 98.5%, degree of polymerization: 500, 10% aqueous solution, commercialized name: PVA-105, product of Kuraray Co., Ltd., hereinafter shortened to Resin E, Example 7), polyvinylalcohol (degree of saponification: 79.5%, degree of polymerization: 2000, 10% aqueous solution, commercialized name: PVA420, product of Kuraray Co., Ltd., hereinafter shortened to Resin F, Example 8) and glyoxal (40% aqueous solution) are used as a fixing agent which does not cause sticking at the temperature higher than 200° C. The mixing ratios at the preparation of D solution are mentioned below.

Example 5

| | |
|---|---|
| Resin C (20%) | 17.5 parts |
| glyoxal (40%) | 0.875 parts |

Example 6

| | |
|---|---|
| Resin D (10%) | 35 parts |
| glyoxal (40%) | 0.875 parts |

Example 7

| | |
|---|---|
| Resin E (10%) | 35 parts |
| glyoxal (40%) | 0.875 parts |

Example 8

| | |
|---|---|
| Resin F (20%) | 35 parts |
| glyoxal (40%) | 0.875 parts |

Example 9

In Example 9, the thermally sensitive recording medium is prepared by same procedure to Example 1. At the formation of glossing layer, as an inorganic pigment, aluminium hydroxide of 1 μm average particle size (40% dispersion) and colloidal silica (average particle size: 0.07–0.1 μm, 40% dispersion, commercialized name: SNOWTEX ZL, product of NISSAN Chemical Industries Co., Ltd.) are used together. The mixing ratio at the preparation of D solution are mentioned below, and the average particle size of inorganic pigment is 0.39 μm.

| | |
|---|---|
| aluminium hydroxide (40%) | 1.67 parts |
| colloidal silica (40%) | 3.33 parts |

Example 10

In Example 10, the thermally sensitive recording medium is prepared by same procedure to Example 1. At the formation of glossing layer, zinc stearate of 5.5 μm average particle size (30% dispersion, commercialized name: HYDRIN Z-7-30, product of Chukyo Yushi Co., Ltd., hereinafter shortened to Slipping agent B) is used as a slipping agent.

| | |
|---|---|
| Slipping agent B (30%) | 1 part |

Example 11

In Example 11, the thermally sensitive recording medium is prepared by same procedure to Example 1. An intermediate layer is formed between thermally sensitive recording layer and glossing layer, and as an inorganic pigment colloidal silica (average particle size: 0.07–0.1 μm, 40% dispersion, commercialized name: SNOWTEX ZL, product of NISSAN Chemical Industries Co., Ltd.), as a fixing agent polyvinylalcohol (degree of saponification: 98.5%, degree of polymerization: 1700, 10% aqueous solution, commercialized name: PVA-117, product of Kuraray Co., Ltd., hereinafter shortened to Resin D, Example 6) and melamine resin (60% aqueous solution, commercialized name: SUMIREZ RESIN 613sp, product of Sumitomo Chemical Industries Co., Ltd.) and as a slipping agent zinc stearate (average particle size: 0.17 μm, 20% dispersion, commercialized name: HYDRIN F-115, product of Chukyo Yushi Co., Ltd., hereinafter shortened to Slipping agent A) are used. These compounds are mixed by the ratio mentioned below and stirred. Thus the coating solution (E solution) is prepared. E solution (dispersion of coating for intermediate layer)

| | |
|---|---|
| colloidal silica A (40%) | 5 parts |
| resin D (10%) | 30.0 parts |
| melamine resin (60%) | 1.67 parts |
| slipping agent A (20%) | 1.25 parts |

The thermally sensitive layer is prepared by same procedure to Example 1, then the coating for intermediate layer is coated at a coating amount of 2 g/m$^2$, further, the coating for glossing layer is coated at a coating amount of 3.0 g/m$^2$. After drying and treating by a super calendar, a thermally sensitive medium of 5000 sec. smoothness is obtained.

Examples 12, 13

In Examples 12 and 13, the thermally sensitive recording medium is prepared by same procedure to Example 11. At the formation of intermediate layer, copolymer of acrylic ester (average particle size: 0.08 μm, 43% dispersion, commercialized name: MOVINYL 735, product of Clariant Polymer Co., Ltd., hereinafter shortened to Resin G, Example 12) and colloidal silica complex copolymer of acrylic ester (average particle size: 0.08 μm, 43% dispersion, commercialized name: MOVINYL 8020, product of Clariant Polymer Co., Ltd., hereinafter shortened to Resin A, Example 13) are used as a fixing agent. The mixing ratio of E solution preparation are mentioned below.

Example 12

| | |
|---|---|
| Resin G (43%) | 6.98 parts |

Example 13

| | |
|---|---|
| Resin A (43%) | 6.98 parts |

Example 14

In Example 14, the thermally sensitive recording medium is prepared by same procedure to Example 11. At the formation of intermediate layer, copolymer of acrylic ester (average particle size: 0.08 μm, 43% dispersion, commercialized name: MOVINYL 735, product of Clariant Polymer Co., Ltd., hereinafter shortened to Resin G) and polyvinylalcohol (degree of saponification: 98.5%, degree of polymerization: 1700, 10% aqueous solution, commercialized name: PVA-117, product of Kuraray Co., Ltd., hereinafter shortened to Resin D) are used as a fixing agent. The mixing ratio of E solution preparation are mentioned below.

| | |
|---|---|
| Resin G (43%) | 5.81 parts |
| Resin D (10%) | 10 parts |

Example 15

In Example 15, the thermally sensitive recording medium is prepared by same procedure to Example 11. At the formation of intermediate layer, aluminum hydroxide of 1 μm average diameter (40% dispersion) is used as an inorganic pigment. The mixing ratio of E solution preparation is mentioned below.

| | |
|---|---|
| aluminium hydroxide (40%) | 5 parts |

Example 16

In Example 16, the thermally sensitive recording medium is prepared by same procedure to Example 11. At the formation of intermediate layer, zinc stearate of 5.5 μm average diameter (30% dispersion, commercialized name: HYDRIN Z-7-30, product of Chukyo Yushi Co., Ltd., Slipping agent B) is used as a slipping agent. The mixing ratio of E solution preparation is mentioned below.

| | |
|---|---|
| slipping agent B (30%) | 0.83 parts |

Comparative Example 1

In Comparative Example 1, the thermally sensitive recording medium is prepared by same procedure to Example 6. At the formation of glossing layer, an inorganic pigment is not added.

Comparative Example 2

In Comparative Example 2, the thermally sensitive recording medium is prepared by same procedure to Example 6. At the formation of glossing layer, polyvinyl alcohol (degree of saponification: approximately 90%, degree of polymerization: 300, 10% aqueous solution, commercialized name: GL-03, product of Nihon Gosei Chemical Co., Ltd., hereinafter shortened to Resin H) and glyoxal (40% solution) is used as a fixing agent. The mixing ratio of D solution preparations are mentioned below.

| | |
|---|---|
| Resin H (10%) | 0.35 parts |
| glyoxal (40%) | 0.875 parts |

Comparative Example 3

In Comparative Example 3, the thermally sensitive recording medium is prepared by same procedure to Example 6. At the formation of glossing layer, glyoxal is not added.

Comparative Example 4

In Comparative Example 4, the thermally sensitive recording medium is prepared by same procedure to Example 1. At the formation of glossing layer, copolymer of acrylic ester (average particle size: 0.08 μm, 43% dispersion, commercialized name: MOVINYL 735, product of Clariant Polymer Co., Ltd., Resin G) is used as a fixing agent. The mixing ratio of D solution preparation is mentioned below.

| | |
|---|---|
| Resin G (43%) | 8.14 parts |

<Heat resistance test for sticking of a fixing composition>

Whether the fixing compositions used in a glossing layer cause sticking at the temperature higher than 200° C. are detected by following method.

(1) Resins A-H used in above mentioned Examples and Comparative Examples, or the compound to which cross-linking agent is added are the fixing compositions (refer to Table 1). On the paper of 60 g/m$^2$ density and 74 μm thickness, the fixing composition is coated by 20 g/m$^2$, left for 5 minutes in an oven of 110° C. and the coated layer of fixing composition is completely hardened.

(2) The obtained coated paper is cut to 4 cm×8 cm size and doubled up so that the coated surface by fixing composition is contacted. Thus the specimen of 4 cm×4 cm size is prepared. (3) The specimen is placed on a hot plate heated to 200° C. and a weight of 500g (whose base diameter is 4 cm) is placed on the specimen for 5 seconds. Then the specimen is cooled down to room temperature, and checked whether the contacted coated surfaces can be removed easily or not, and indicated by following standard (refer to Table 1).

no sticking is observed
almost no sticking and easily removed
partially sticking and can be removed
can not be removed <Evaluation of thermal recording property>

Thermal recording was carried out on the prepared thermally sensitive recording media using TH-PMD (thermally sensitive printer in which thermal head is installed, product of Kyocera Co., Ltd.) by 0.41 mj/dot impressive energy. Recording density of the recorded portion is measured by means of a Macbeth densitometer (RD-914, amber filter used) (refer to Table 2 and Table 3).

<Evaluation of degree of glossiness>

A digital glossiness meter (Product of Murakami Color Technique Laboratory Co., Ltd., Model GM-26D For 75°) is used. The degree of glossiness (an angle of incidence and an angle of reflection is 75°) of the non-recorded part is measured (refer to Table 2 and Table 3).

<Evaluation for plasticizer resistance >

A single sheet of polyvinylchloride wrap( HIGHWRAP KMA: Mitsui Toatsu Chemicals Co., Ltd.) was wound round with 1 ply on a paper tube, stuck thereon a thermal recording medium recorded by the above printer, further wound round with 3

<Thermal head aptitude>

A checker mark is printed, using an automatic measuring label assurance system IP-21100ZX of Ishida Co., Ltd., setting printing density to 9, and whether the glossing layer is destroyed by heat (surface looses glossiness by heat, or removed) is observed and indicated by following standard (refer to Table 2 and Table 3).

not destroyed by heat destroyed by heat

<Evaluation of printing aptitude>

RI printer (RI-III type) of AKIRA Co., Ltd. is used as the printer and UV hardening type ink Tack 12, product of Dainippon Ink Chemical Industries Co., Ltd. is used as an ink, and evaluation of printing aptitude (surface intensity, transferring of ink etc.) is measured and indicated by following standard (refer to Table 2 and Table 3).

good surface intensity is good, ink transferring is not good not good

TABLE 1

| glossing layer fixing composition | | |
|---|---|---|
| resin (*1) | cross-linking agent(*2) | heat resistance for sticking |
| resin A | — | |
| resin B | — | |
| resin C | glyoxal (0.1) | |
| resin D | — | |
| resin D | glyoxal (0.1) | |
| resin E | glyoxal (0.1) | |
| resin F | glyoxal (0.1) | |
| resin G | — | |
| resin H | glyoxal (0.1) | |

(*1) resin A–H indicates following compound

Resin A: copolymer of colloidal silica complex acrylic ester (average particle size: 0.04 μm), 43% dispersion Resin B: copolymer of (meth)acrylic ester (average particle size: 0.37 μm), 25% dispersion Resin C: copolymer of (meth)acrylicester (average particle size: 0.25 μm), 20% dispersion Resin D: polyvinylalcohol, degree of saponification: 98.5%, degree of polymerization: 1700, 10% aqueous solution Resin E: polyvinylalcohol, degree of saponification: 98.5%, degree of polymerization: 500, 10% aqueous solution Resin F: polyvinylalcohol, degree of saponification: 79.5%, degree of polymerization: 2000, 10% aqueous solution Resin G: copolymer of acrylic ester (average particle size: 0.08 μm), 43% dispersion Resin H: polyvinylalcohol, degree of saponification: ca. 90%, degree of polymerization: 300, 10% aqueous solution (*2) number in parenthesis indicates parts of cross-linking agent to 1 part of resin.

TABLE 2

| | intermediate layer | | glossing layer | |
|---|---|---|---|---|
| Example Co. Ex. | inorganic pigment | fixing composition | inorganic pigment | fixing composition |
| 1 | — | — | colloidal Si | Resin A |
| 2 | — | — | $BaSO_4$ | Resin A |
| 3 | — | — | $TiO_2$ | Resin A |

TABLE 2-continued

| | intermediate layer | | glossing layer | |
|---|---|---|---|---|
| Example Co. Ex. | inorganic pigment | fixing composition | inorganic pigment | fixing composition |
| 4 | — | — | colloidal Si | Resin B |
| 5 | — | — | colloidal Si | Resin C/glyoxal |
| 6 | — | — | colloidal Si | Resin D/glyoxal |
| 7 | — | — | colloidal Si | Resin E/glyoxal |
| 8 | — | — | colloidal Si | Resin F/glyoxal |
| 9 | — | — | colloidal Si/ $Al(OH)_3$ | Resin A |
| 10 | — | — | colloidal Si | Resin A |
| 11 | colloidal Si | Resin D/Me. resin | colloidal Si | Resin A |
| 12 | colloidal Si | Resin G | colloidal Si | Resin A |
| 13 | colloidal Si | Resin A | colloidal Si | Resin A |
| 14 | colloidal Si | Resin G/ Resin D | colloidal Si | Resin A |
| 15 | $Al(OH)_3$ | Resin D/Me. resin | colloidal Si | Resin A |
| 16 | colloidal Si | Resin D/Me. resin | colloidal Si | Resin A |
| Co.Ex.1 | — | — | — | Resin D/glyoxal |
| Co.Ex.2 | — | — | colloidal Si | Resin H/glyoxal |
| Co.Ex.3 | — | — | colloidal Si | Resin D |
| Co.Ex.4 | — | — | colloidal Si | Resin G |

Remarks

"colloidal Si "indicates colloidal silica,

"Me.resin" indicates Melamine resin

"Co.Ex." indicates Comparative Example

TABLE 3

| Example Co. Ex. | degree of glossiness | recording density | resistance to plasticizer | head aptitude | printing aptitude |
|---|---|---|---|---|---|
| 1 | 81% | 1.50 | 0.32 | | |
| 2 | 80% | 1.50 | 0.31 | | |
| 3 | 80% | 1.52 | 0.31 | | |
| 4 | 77% | 1.41 | 0.38 | | |
| 5 | 76% | 1.40 | 0.37 | | |
| 6 | 81% | 1.47 | 0.50 | | |
| 7 | 79% | 1.44 | 0.40 | | |
| 8 | 80% | 1.44 | 0.42 | | |
| 9 | 53% | 1.30 | 0.15 | | |
| 10 | 64% | 1.35 | 0.20 | | |
| 11 | 84% | 1.54 | 1.05 | | |
| 12 | 85% | 1.55 | 0.89 | | |
| 13 | 85% | 1.54 | 0.45 | | |
| 14 | 84% | 1.53 | 0.98 | | |
| 15 | 75% | 1.36 | 0.80 | | |
| 16 | 77% | 1.40 | 0.75 | | |
| Co.EX.1 | 81% | 1.54 | 0.55 | | |
| Co.EX.2 | 80% | 1.41 | 0.30 | | |
| Co.Ex.3 | 80% | 1.44 | 0.27 | | |
| Co.Ex.4 | 77% | 1.40 | 0.39 | | |

As clearly understood from above mentioned results, Examples 1–10 which have a glossing layer of this invention, display good results at degree of lustrous, recording density, head aptitude and printing aptitude. Further, the Examples 11–16 which has an intermediate layer display good resistance to a plasticizer. On the contrary, Comparative Example 1 which does not contain inorganic pigment in a glossing layer is not good in the printing aptitude. In comparative Examples 2–4 which use a fixing composition not having heat resistance for sticking prescribed in this invention, since the glossing layer is destroyed by heat at the printing process, is not suited to the practical use.

Meanwhile, in the Examples of this invention, Examples which use materials whose average particle size is smaller than 0.3 μm are superior in degree of glossiness to Examples 9, 10, 15 and 16 which use inorganic pigment whose average diameter is bigger than 0.3 μm. Therefore, if more excellent degree of glossiness is required, it is effective to use the materials whose average particle size is smaller than 0.3 μm.

The thermally sensitive recording medium of this invention is the medium which has a glossing layer mainly containing fixing composition which does not cause sticking at the temperature higher than 200° C., which has a good lustrous property and has a thermal head aptitude and a printing aptitude. By above mentioned structural characteristics, the thermally sensitive recording medium of this invention becomes to have high lustrous property and high image density and evaluated as a high quality medium. It is not necessary to coat a varnish layer using organic solvent on it and so is very economical. Furthermore, by forming an intermediate layer between thermally sensitive recording layer and a glossing layer, degree of glossiness is improved more, and resistance to plasticizer is improved more, and the useful thermally sensitive recording medium can be obtained.

What is claimed is:

1. A thermally sensitive recording medium comprising a substrate, a thermally sensitive recording medium supported on said substrate, and a glossing layer on said thermally sensitive recording layer, wherein said glossing layer comprises an inorganic pigment and a fixing composition, wherein the surface glossiness of the glossing layer, measured according to for light at an angle of incidence and angle of reflection of 75°, is greater than 50%, wherein said inorganic pigment is at least one pigment selected from the group consisting of colloidal silica, barium sulfate, titanium oxide and aluminum hydroxide, wherein the inorganic pigment and fixing composition have an average particle size not larger than 0.3 μm, and wherein the amount of fixing composition having an average particle size of more than 0.3 μm is not more than 0.03 parts by weight per part by weight of particles having an average particle size not larger than 0.3 μm and further wherein said fixing composition does not cause sticking at a temperature higher than 200° C., as determined under the following conditions:

(1) the fixing composition is coated at a rate of 20 g/cm$^2$, on paper having a density of 60 g/cm$^2$ and a thickness of 74 μm, and heated for 5 minutes at a temperature of 110° C., such that the coating layer of the fixing composition is completely hardened;

(2) the obtained coated paper is cut to a size of 4 cm×8 cm and doubled up with the coated surface contacting itself, to form a sample specimen of 4 cm×4 cm;

(3) the specimen is placed on a hot plate heated to 200° C.;

(4) a weight of 500 g (whose base diameter is 4 cm) is placed on the specimen for 5 seconds, after which the specimen is cooled down to room temperature, and the folded specimen is unfolded easily without sticking.

2. A thermally sensitive recording medium comprising a substrate, a thermally sensitive recording medium supported on said substrate, and a glossing layer on said thermally sensitive recording layer, wherein said glossing layer comprises an inorganic pigment and a fixing composition, wherein the surface glossiness of the glossing layer, measured according to JIS-P-8142, for light at an angle of incidence and angle of reflection of 75°, is greater than 50%, wherein said inorganic pigment is at least one pigment selected from the group consisting of colloidal silica, barium sulfate, titanium oxide and aluminum hydroxide, and further wherein said fixing composition does not cause sticking at a temperature higher than 200° C. as determined under the following conditions:

(1) the fixing composition is coated at a rate of 20 g/cm$^2$, on paper having a density of 60 g/cm$^2$ and a thickness of 74 μm, and heated for 5 minutes at a temperature of 110° C., such that the coating layer of the fixing composition is completely hardened;

(2) the obtained coated paper is cut to a size of 4 cm×8 cm and doubled up with the coated surface containing itself, to form a sample specimen of 4 cm×4 cm;

(3) the specimen is placed on a hot plate heated to 200° C.;

(4) a weight of 500 g (whose base diameter is 4 cm) is placed on the specimen for 5 seconds, after which the specimen is cooled down to room temperature, and the folded specimen is unfolded easily without sticking, and wherein an intermediate layer comprising an inorganic pigment and a fixing composition is interposed between the thermally sensitive recording medium and the glossing layer.

3. The thermally sensitive recording medium of claim 1 or claim 2, wherein the fixing composition comprises at least one kind of water soluble polymer or resin selected from the group consisting of polyvinylalcohol of 200 to 2500 polymerization degree, and water soluble high polymer of cellulose derivative.

4. The thermally sensitive recording medium of claim 3, wherein the fixing composition comprises said polyvinylalcohol and is selected from the group consisting of saponified polyvinylalcohol, partially saponified polyvinylalcohol, and denatured polyvinylalcohol.

5. The thermally sensitive recording medium of claim 3, wherein the fixing composition comprises a partially saponified polyvinylalcohol whose degree of saponification is 79.5–98.5%.

6. The thermally sensitive recording medium of claim 3, wherein the fixing composition comprises said denatured polyvinylalcohol and which is denatured by carboxyl, by amide, by sulfonic acid or by butyl aldehyde.

7. The thermally sensitive recording medium of claim 3, wherein the fixing composition comprises said polymer of cellulose derivative and is selected from the group consisting of hydroxyethyl cellulose, methylcellulose, ethyl cellulose, carboxymethyl cellulose and acetyl cellulose.

8. The thermally sensitive recording medium of claim 1 or claim 2, wherein the fixing composition comprises (meth) acrylic acid ester copolymer.

9. The thermally sensitive recording medium according to claim 8, wherein said (meth)acrylic acid ester is selected from the group consisting of copolymers of (meth)acrylic acid ester, copolymers of styrene and/or vinyl acetate, poly (acrylamide/acrylic acid ester/methacrylic acid), copolymer of colloidal silica complex acrylic acid ester and copolymer of colloidal silica complex styrene/acrylic acid ester.

10. The thermally sensitive recording medium of claim 1 or claim 2, wherein the content of the inorganic pigment and the fixing composition are, respectively, 30–60 wt %, based on the total weight of solid of the glossing layer, and the amount of the fixing composition is 0.6–3.5 parts by weight per 1 part of the inorganic pigment.

11. The thermally sensitive recording medium of claim 1 or claim 2, wherein the fixing composition is crosslinked.

12. The thermally sensitive recording medium according to claim 1 or claim 2, wherein said fixing composition comprises polyvinylalcohol having a degree of saponification of at least about 90%, and a polymerization degree of at least 1000.

* * * * *